United States Patent [19]

Krzywdziak

[11] Patent Number: 4,793,528

[45] Date of Patent: Dec. 27, 1988

[54] LID WITH AN ADJUSTABLE POURING AND VENTING ARRANGEMENT, PARTICULARLY FOR PRIMARY COLOR OR PAINT CONTAINERS UTILIZED FOR CAR BODYWORK

[75] Inventor: Alain Krzywdziak, Saint-Denis-en-Val, France

[73] Assignee: Fonderie & Ateliersdes Sablons, Orleans, France

[21] Appl. No.: 57,612

[22] Filed: Jun. 3, 1987

[30] Foreign Application Priority Data

Jul. 4, 1986 [FR] France ..... 86 09782

[51] Int. Cl.[4] ..... B67D 3/00

[52] U.S. Cl. ..... 222/487; 222/505; 222/511; 222/561; 222/506

[58] Field of Search ..... 222/472, 473, 487, 505, 222/511, 561, 506, 484

[56] References Cited

U.S. PATENT DOCUMENTS

| | | | |
|---|---|---|---|
| 2,154,581 | 4/1939 | Pershall | 222/473 |
| 2,162,348 | 6/1939 | Hacmac | 222/473 X |
| 2,274,844 | 3/1942 | Moss | 222/511 |
| 2,312,584 | 3/1943 | Peterson | 222/511 X |
| 3,021,118 | 2/1962 | Dedoes | 222/561 X |
| 3,041,052 | 6/1962 | Dedoes | 222/484 |
| 4,585,148 | 4/1986 | Ito | 222/144.5 X |

*Primary Examiner*—Joseph J. Rolla
*Assistant Examiner*—David H. Bollinger
*Attorney, Agent, or Firm*—Scully, Scott, Murphy & Presser

[57] ABSTRACT

A lid with an adjustable "quillotine" type pouring arrangement, adapted to be mounted, in particular, on the primary color or paint containers for car bodywork and employed in paint stirring machines. The lid includes at least one component for fixing the lid on a color container; a pouring spout on the lid with an opening portion of this pouring spout being substantially planar; an operating lever which has a lower end pivotably hinged to an upper wall of the lid, and which lever is movable between a resting position and a depressed working position; and a sliding element which is also substantially planar and which is slidable in surface contact with the planar pouring spout opening portion so as to sealingly close the latter. The sliding element is adapted to be pulled in response to depression of the operating lever so as to enable pouring through the opening portion of the spout; wherein the operating lever, on its front side and at a distance from the pouring spout, is provided with a stop member fixing the operating lever in the rest position and sealingly pressing against a venting orifice on the upper wall of the lid.

9 Claims, 2 Drawing Sheets

LID WITH AN ADJUSTABLE POURING AND VENTING ARRANGEMENT, PARTICULARLY FOR PRIMARY COLOR OR PAINT CONTAINERS UTILIZED FOR CAR BODYWORK

BACKGROUND OF THE INVENTION

1. Field of the Invention

The present invention relates to a lid with an adjustable "guillotine" type pouring arrangement, adapted to be mounted, in particular, on the primary color or paint containers for car bodywork and employed in paint stirring machines.

2. Discussion of the Prior Art

It is known in the technology with respect to this type of pouring arrangement, that proper ventilation or venting of the interior of the paint or color container is of vital significance during pouring of the paint, in ensuring a uniform paint color flow and therefore facilitates the satisfactory pouring of the paint.

In order to meet this demand, the present invention contemplates the provision of a pouring arrangement of this type, which possesses a simple structure and which is especially adapted to meet this need for a uniform flow of the paint during pouring thereof.

SUMMARY OF THE INVENTION

The invention has as its object the provision of a lid with a pouring arrangement, which is particularly adapted for primary color or paint containers on stirring machines, and which includes:

(a) at least one component for fixing the lid on a color container;

(b) a pouring spout on the lid with an opening portion of this pouring spout being substantially planar;

(c) an operating lever which has a lower end pivotably hinged to an upper wall of the lid, and which lever is movable between a resting position and a depressed working position; and (d) a sliding element which is also substantially planar and which is slidable in surface contact with the planar pouring spout opening portion so as to sealingly close the latter.

The sliding element is adapted to be pulled in response to depression of the operating lever so as to enable pouring through the opening portion of the spout; wherein the operating lever, on its front side and at a distance from the pouring spout, is provided with a stop member fixing the operating lever in the rest position and sealingly pressing against a venting orifice on the upper wall of the lid. The sliding piece is rigidly connected with the operating lever through the intermediary of an articulated member which, on the one hand, is hingedly connected with the upper middle portion of the sliding element and, on the other hand, with the operating lever, and at a distance from its hinging axis, including spring means for causing the sliding element to return and bear under pressure against the opening portion of the pouring spout, and returning the operating lever into its resting position in which the opening portion of the pouring spout is maintained closed by the sliding element.

In view of this arrangement, in the resting position, the operating lever closes the venting orifice of the color or paint container, which is thereby completely sealed off from the external atmosphere, and when depressed into the working position, the lever draws the sliding element so as to open the pouring spout while concurrently opening the venting orifice which, during pouring, due to its location at a distance from the pouring spout is, on the one hand, protected from any contact with the liquid or paint in the pouring position of the container while, on the other hand, it permits air to be properly aspirated into the container, so as to thereby facilitate the uniform flow of color or paint through the pouring spout.

According to advantageous structural features of the invention, the operating lever includes the stop member in the form of a lug projecting perpendicularly relative to the operating lever and in proximity to its hinging axis.

The ventilation orifice is cylindrical in configuration and projects slightly from the upper surface of the lid wall.

The operating lever also includes a second stop member on its rear side, limiting the extent of the rotation of the lever into its working position.

The articulated member is preferably a U-shaped rod, the straight middle or base portion intermediate the arm portions thereof forms a horizontal hinging axis rotatably guided between two spaced shoulders formed on the upper wall surface of the sliding element and the ends of the opposite parallel arms which are curved inwardly so as to freely rotatably engage in matching bore holes provided in the body of the operating lever.

The hinging shoulders on the sliding element are located in proximity to the ends of the straight base portion of the articulated rod, and the free distal ends of the arms are attached close to the external edge of the bore holes in tee operating lever. Consequently, the inherent rigidity of the rod which is hinged in this manner ensures the precise displacement of the sliding element, the latter of which is guided in its longitudinal movement by small lower side plates, thereby following the simple generally vertical movement of the operating lever.

The operating lever is hinged to a portion of the lid which is located substantially diametrically opposite the pouring spout. The venting orifice is therefore arranged behind the stirring shaft, relative to the location of the pouring spout. The articulated U-shaped rod encompasses or extends about the stirring shaft and therefore the arms thereof extend over a substantially large span, and with the arms being inclined upwardly towards the operating lever.

The spring arrangement consists of two simple coil springs with continuous helical turns, operated by a pulling force. The springs are arranged to extend in parallel in each of the respectively vertical planes passing through the opposite arms of the rod and are each connected at their respective ends, on the one hand, to the base of the pouring spout below the sliding element and, on the other hand, to one of the opposite arms of the U-shaped rod at substantially its middle portion which is provided with a fastening bend formed thereon at a distance from the hinging or pivot axis of the operating lever. As a result, each tensioned spring exerts a positive turning moment or torque on the operating lever, causing it to normally return into the resting position thereof. Similarly, the distance between the hinging axis of the articulated rod on the sliding element and the lower end of the connection between each of the springs and the base of the pouring spout produces a vertical load component which presses the sliding element downwardly against the opening portion of the pouring spout. This vertical load component effectively assists in producing a good sealing action between the sliding element and the opening portion of the pouring spout.

Moreover, this inventive structure avoids the drawback of conventional prior art devices which are subjected to the friction of leaf springs which bear against the sliding element and consequently, avoids an excessive friction, encountered particularly in the presence of thick or dry paint between the sliding element and such leaf springs.

For reasons of ease in manufacture, convenience of disassembly and interchangeability of parts, the sliding element and the operating lever may be constituted from molded components, the sliding piece being preferably constituted of Zamak (a registered trademark of New Jersey Zinc Co.) with a Teflon (a registered trademark of E.I. Du Pont de Nemours & Co., Inc.) surface coating, and the lever being constituted of a plastic material. The shoulders on the sliding element are open, and the bore holes in the operating lever may also consist of an open recess adapted to receive the free curved ends of the arms of the rod. The articulated rod may also be arranged in a direction opposite to the direction mentioned hereinabove, with its U-shaped portion accommodated within the recess of the operating lever, its curved arm end portions thus being received by the shoulders on the sliding element. Since the rod is biased towards the front and downwardly, it cannot exit from the opening in the shoulders on the sliding element or the recess in the operating lever.

BRIEF DESCRIPTION OF THE DRAWINGS

Reference may now be had to the following detailed description of a preferred embodiment of the invention, taken in conjunction with the accompanying drawings; in which.

DETAILED DESCRIPTION

Figure 1:
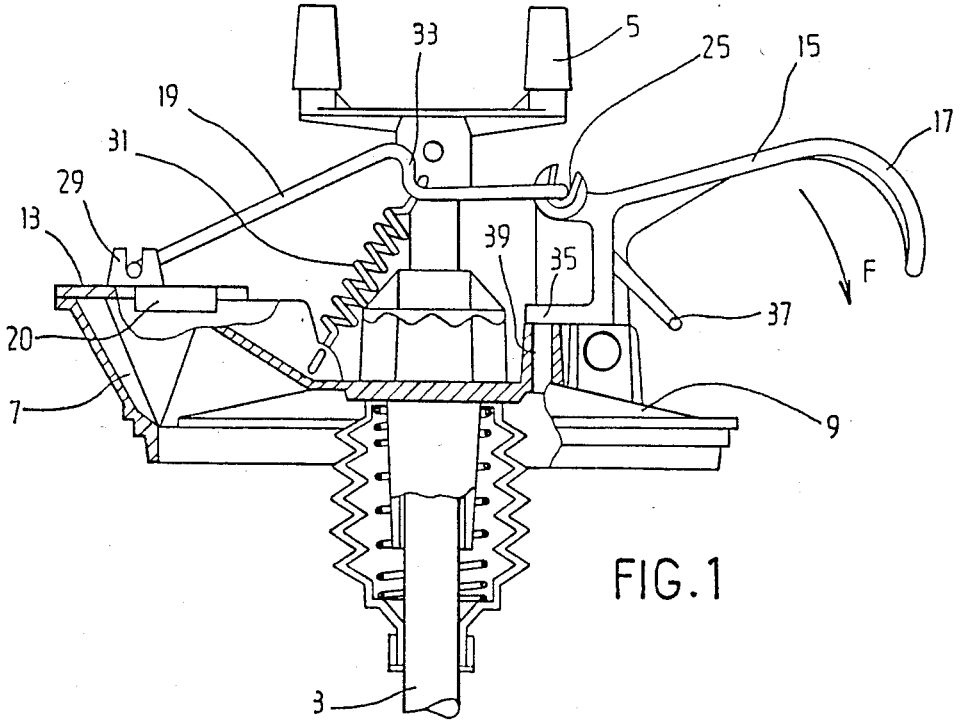
FIG. 1 is a partially sectional view of a lid pursuant to the invention, shown in the closed resting position thereof.
Figure 3:
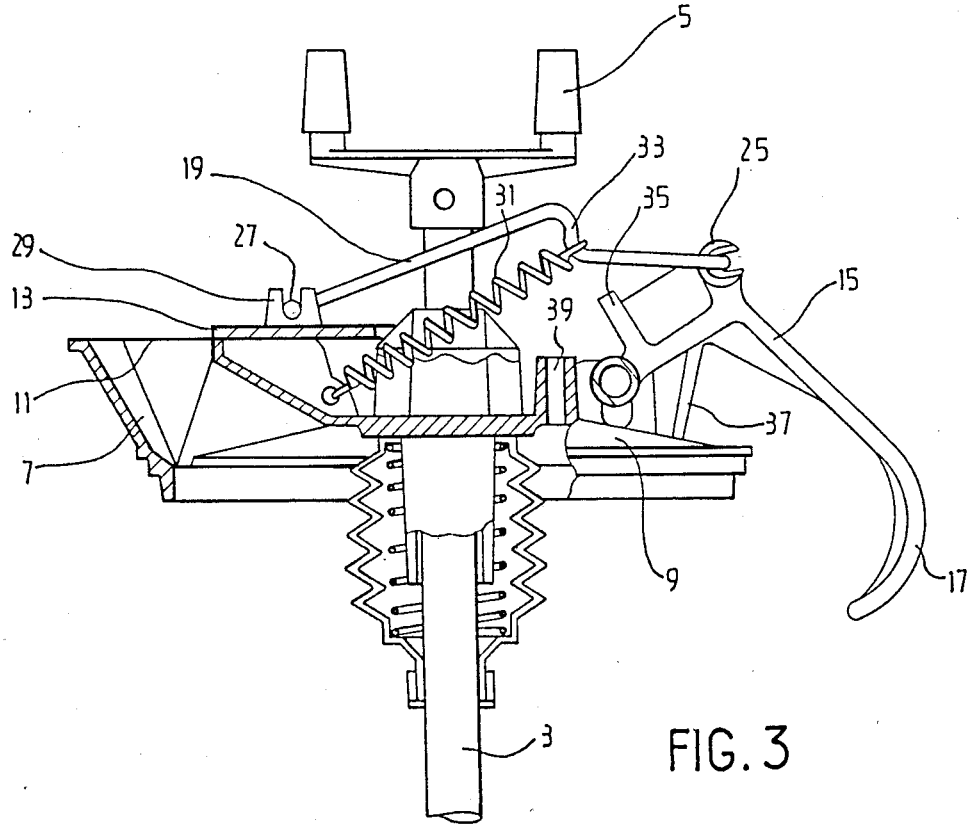
FIG. 3 is a view similar to FIG. 1, with the lid shown in the open working position.

With reference to the drawing figures, the lid according to the invention is intended to be mounted on a paint container (not shown) by means of conventional cam lug locking devices 1 which are fastenable to the inside rim of the container. The lid incorporates a propeller mixer 3 which has a vertical shaft and is rotated by the bifurcated or pinion drive unit 5 of a stirring machine. As can be ascertained in particular from FIG. 1, a pouring spout 7 projects from the outer side portion of the lid. This pouring spout 7 is somewhat elevated relative to the external upper wall surface 9 of the lid, so as to enable the paint to flow more easily. The outlet orifice of the pouring spout 7 has a dihedral cross section and the opening portion 11, which is normally sealingly closed by a sliding element 13, is planar. The sliding element 13 is operated so as to open (FIG. 3) through the manipulation of an operating lever 15 which is equipped with an end trigger 17 which facilitates detachment of the lid from the stirring machine. The lateral sliding movement of the sliding element 13 on the opening portion 11 is achieved by means of an articulated U-shaped rod 19, the sliding element being guided without lateral play by small upstanding side plates 20.

Figure 2:
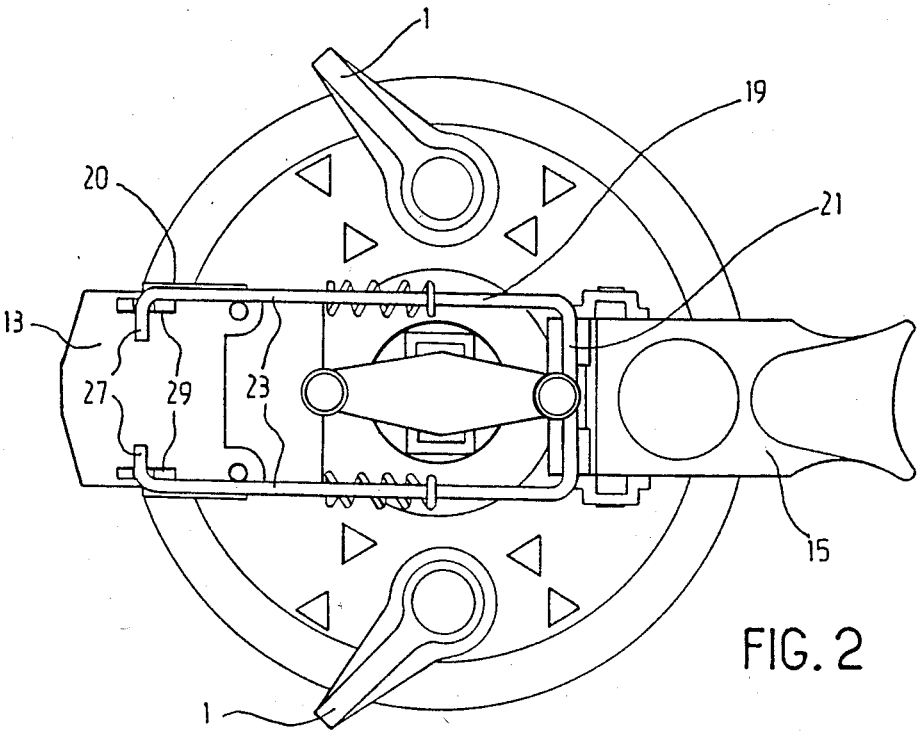
FIG. 2 is a top plan view of the lid of FIG. 1.

The U-shaped rod 19 comprises a straight middle portion 21 (FIG. 2) and two arms 23 extending from the opposite ends thereof arranged substantially in parallel on either side of the stirring shaft 3. The straight middle portion 21 is pivotably supported in an open recess bore hole 25 formed at the angled corner between the vertical extension of the operating lever 15 and its gripping stem. The opposite arms 23 are each provided at their free or distal ends wit a right-angled bent portion 27 which engages into a lateral upwardly projecting shoulder 29 integrally formed with the sliding element 13. These arms are rotatably but rigidly supported on the two shoulders 29 on the sliding element. The respective hinging axes of the rod relative to the operating lever 15 and of the rod relative to the sliding element 13 are parallel to the opening portion of the pouring spout, such that the sideway displacement of the sliding element is in parallel with the opening portion.

Two parallel located coil springs 31 with continuous helical turns, are each respectively connected, on the one hand, to the base of the pouring spout and, on the other hand, to each of the arms 23 of the rod at a right-angled fastening bend formed in the arms of the rod, so as to ensure that the operating lever 15 returns to the closed resting position and, at the same time, ensuring that the sliding element is pressed downwardly into contact against the opening portion of the pouring spout. This downward pressing action ensures the formation of a sealed closure, and takes placed along the entire extent of the opening movement for the sliding element.

The operating lever has a front extension or lug 35 thereon forming a stop in the resting position of the lever, a downwardly extending rear tailpiece 37 limiting the rotational movement (arrow F) of the operating lever and, consequently, the opening displacement of the sliding element 13. The front lug 35, which is perpendicular to the body of the operating lever, when the latter is in the resting position, bears against a cylindrical vent orifice 39 formed in the wall of the lid and located behind the stirring shaft 3, relative to the pouring spout, so as to produce a sealed closure. When the operating lever is in the resting position, the venting orifice 39 is closed and the interior of the container is therefore completely sealed off from the exterior. This orifice 39 is only opened when the operating lever 15 is depressed (arrow F) and the paint is poured through the pouring spout opening.

Since this orifice 39 is located at some distance from the pouring spout (behind the stirring shaft), when the lid and the associated container are inclined in order to pour the paint, the venting orifice is elevated relative to the pouring spout, thereby distancing the paint level in the container still further from the venting orifice and, accordingly, inhibiting any possibility of this orifice being contaminated or clogged by the paint.

Furthermore, the feature that the venting orifice 39 is located at some distance from the pouring spout 7 helps to ensure the provision of a stable atmosphere within the container, and consequently for a uniform flow of paint during pouring.

What is claimed is:

1. Lid with a pouring device for primary color or paint containers on stirring machines; comprising at least one latching member for fastening said lid on the opening of a container; a pouring spout having an opening portion with a planar upper surface; and operating lever having a lower end pivotably connected to an upper wall of the lid and being displaceable between a resting position and a depressed working position;

a sliding element having a planar bottom surface slidable on said opening portion for selective sealing and opening thereof, said sliding element being displaced responsive to depression of said operating lever to enable pouring of paint through said pouring spout opening; a stop member on the front side of the operating lever spaced at a distance from the pouring spout for maintaining said operating lever in the resting position and concurrently sealingly pressing against a venting orifice on the upper wall of said lid, an articulating member connecting the sliding element to said operating lever, said articulating member being hingedly connected with, respectively, the upper middle portion of the sliding element and with said operating lever at a distance from its pivot axis; spring means for biasing said sliding element to return and bear with pressure against the opening portion of the pouring spout and said operating lever so as to return the lever into the resting position in which the opening portion of the pouring spout is sealingly closed by the sliding element, wherein said articulated member comprises a U-shaped rod having a straight middle portion and parallel arms extending from the ends of said portion and arranged on opposite sides of a stirring shaft and being curved inwardly towards each other at their free ends, said curved ends and the straight middle portion of the rod forming the hinging axes of the rod with respectively the sliding element and with the operating lever, said rod being connected to the sliding element through upstanding shoulders on the upper surface of the sliding element, and to the operating lever through bore holes formed in said lever, the plane of the sliding element and the respective hinging axes of the rod with the sliding element and the operating lever being in parallel with each other and perpendicular to the stirring shaft, the sliding element being guided over the opening portion of the pouring spout by side plates extending along side edges of the sliding element.

2. Lid as claimed in claim 1, wherein said stop member comprises a lug projecting perpendicularly relative to the operating lever in proximity to the pivoting axis of said lever.

3. Lid as claimed in claim 1, wherein said venting orifice is cylindrical and projects upwardly from the upper wall surface of the lid.

4. Lid as claimed in claim 1, wherein said operating lever is provided with a rear stop member for limiting the rotational movement of said lever into the working position.

5. Lid as claimed in claim 1, wherein the shoulders on the sliding element have upwardly facing openings, and the bore holes in the operating lever comprise a recess which opens towards the exterior.

6. Lid with a pouring device for primary color or paint containers on stirring machines; comprising at least one latching member for fastening said lid on the opening of a container; a pouring spout having an opening portion with a planar upper surface; and operating lever having a lower end pivotably connected to an upper wall of the lid and being displaceable between a resting position and a depressed working position;

a sliding element having a planar bottom surface slidable on said opening portion for selective sealing and opening thereof, said sliding element being displaced responsive to depression of said operating lever to enable pouring of paint through said pouring spout opening; a stop member on the front side of the operating lever spaced at a distance from the pouring spout for maintaining said operating lever in the resting position and concurrently sealingly pressing against a venting orifice on the upper wall of said lid, an articulating member connecting the sliding element to said operating lever, said articulating member being hingedly connected with, respectively, the upper middle portion of the sliding element and with said operating lever at a distance from its pivot axis; spring means for biasing said element to return and bear with pressure against the opening portion of the pouring spout and said operating lever so as to return the lever into the resting position in which the opening portion of the pouring spout is sealingly closed by the sliding element, said articulated member comprising a U-shaped rod having a straight middle portion and parallel arms extending from the ends of said portion and arranged on opposite sides of a stirring shaft and being curved inwardly towards each other at their free ends, said curved ends and the straight middle portion of the rod forming the hinging axes of the rod with respectively the sliding element and with the operating lever, wherein said spring means comprises two coil springs each having continuous helical turns and being operative in response to a tensioning force, said springs each being arranged in parallel vertical planes passing through the opposite arms of the rod and each being connected at the respective ends thereof to the base of the pouring spout below the sliding element and to one of the opposite arms of the rod at substantially the middle portion of the rod having a right-angled fastening bend formed therein at a distance from the pivoting axis of the operating lever.

7. Lid as claimed in claim 6, wherein said stop member comprises a lug projecting perpendicularly relative to the operating lever in proximity to the pivoting axis of said lever.

8. Lid as claimed in claim 6, wherein said venting orifice is cylindrical and projects upwardly from the upper wall surface of the lid.

9. Lid as claimed in claim 6, wherein said operating lever is provided with a rear stop member for limiting the rotational movement of said lever into the working position.

* * * * *